United States Patent [19]

Powers

[11] Patent Number: 4,943,052

[45] Date of Patent: Jul. 24, 1990

[54] FREE-WEIGHT EXERCISING BARBELLS

[76] Inventor: Brice Powers, 2234 S. 15th Ave., Broadview, Ill. 60153

[21] Appl. No.: 302,819

[22] Filed: Jan. 27, 1989

[51] Int. Cl.[5] ..... A63B 13/00

[52] U.S. Cl. ..... 272/123; 272/117; 272/122; 272/143

[58] Field of Search ..... 272/67, 116, 117, 119, 272/122, 123, 124, 143

[56] References Cited

U.S. PATENT DOCUMENTS

| | | | |
|---|---|---|---|
| 4,029,312 | 6/1977 | Wright | 272/123 |
| 4,231,569 | 11/1980 | Rae | 272/117 X |
| 4,345,756 | 8/1982 | Hoagland | 272/117 |
| 4,618,142 | 10/1986 | Joseph, Jr. | 272/123 X |
| 4,720,096 | 1/1988 | Rogers | 272/123 X |
| 4,749,188 | 6/1988 | Montgomery | 272/117 X |
| 4,756,526 | 7/1988 | Broussard | 272/117 X |
| 4,807,873 | 2/1989 | Naquin | 272/117 X |

*Primary Examiner*—Robert W. Bahr
*Attorney, Agent, or Firm*—Charles F. Lind

[57] ABSTRACT

The disclosed exercising barbell has a substantially rigid frame having gripping, support and weight portions spaced apart and oriented such that the center of gravity of the barbell is spaced from both the gripping and support portions. The gripping portion is suited to be gripped by an exerciser's hand, and the support portion is suited then to cooperate with a part of the exerciser's body spaced from the gripping hand; and straps near the support portion may be looped around and secured in a looped fashion to hold the support portion to said spaced part of the exerciser's body. This forms a two-point support of the barbell relative to the exerciser, to allow the exerciser to move the barbell vertically between lower and upper positions in the course of an exercise, whereby the muscle(s) of the exerciser must be stressed. The center of gravity of the barbell is generally proximate the weight portion but is spaced from the gripping and support portions; and in the upper position, said weight portion is horizontally spaced from the gripping hand and the path of movement of the gripping hand during the exercise movement, to cause the barbell to continue to stress the same lifting muscle(s) of the exerciser.

11 Claims, 2 Drawing Sheets

FIG. 6
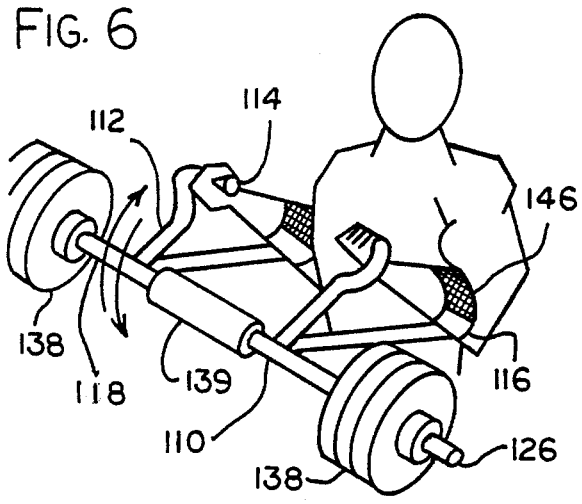
FIG. 7
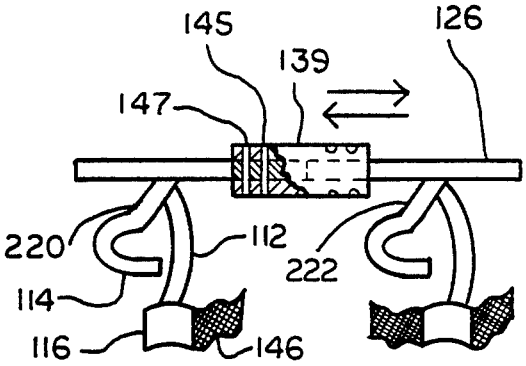
FIG. 8
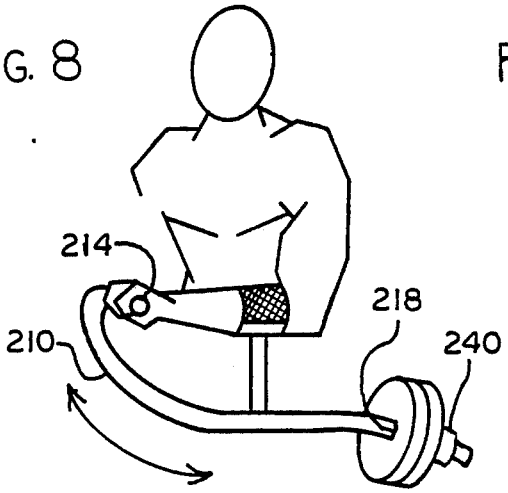
FIG. 9
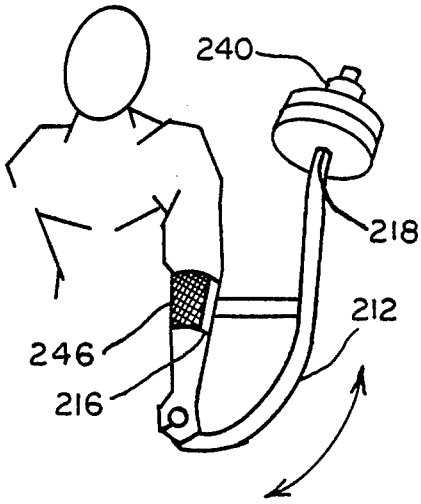
FIG. 11
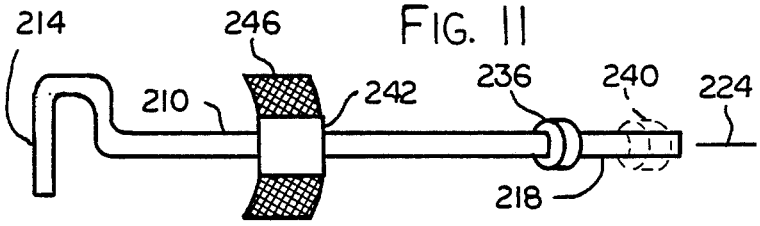
FIG. 5
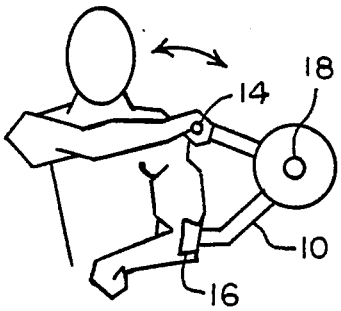
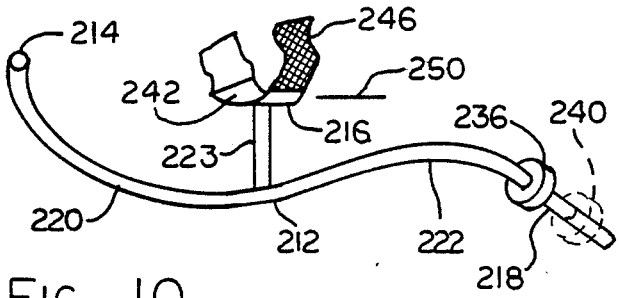
FIG. 10

FREE-WEIGHT EXERCISING BARBELLS

FIELD OF THE INVENTION

This invention relates to free-weight barbells of the type an exerciser would, during exercising, provide the sole support for while moving generally along vertically disposed paths between lower and upper positions, effective to stress specific muscles.

BACKGROUND OF THE INVENTION

A free-weight exercising barbell typically is a weighted form, shaped and sized to allow the exerciser to grip it securely, and to lift it and move it around during exercising. Free-weight barbells, during exercising, are solely supported by the exerciser and not by any structural means in the form of frame guides, cables or the like, as is common on stationary exercise machines.

A typical free-weight exercising barbell may consist of a pair of substantially equal weights spaced apart near the opposite ends of a gripping handle or bar, which may be long enough to allow it to be gripped between the weights by only one hand or by both hands. The center of gravity of the barbell generally is located somewhere along the axis of the gripping bar, typically at the mid-point of a barbell, symmetrically of the one-hand grip or between the two-hand grip.

During a typical exercise, an exerciser may lift the barbell between lower and upper positions, once or repetitively, whereupon specific muscles will be stressed to varying degrees of maximum. Exercises may be done: (1) with both hands gripping and moving a single barbell, to move in unison and cooperatively together; (2) with only a single hand gripping and moving a single barbell, while the other hand would be free and not involved in the exercise; or (3) with each hand gripping and moving a separate barbell, independently and not necessarily in unison or cooperatively.

The movement of the gripping hand(s) generally will be along a path having a large vertical component, perhaps even straight up-and-down; may be arcuately with both horizontal and vertical components; or could even be only horizontally.

Unless otherwise referring to a specific barbell of this disclosure, for simplicity sake, the general discussion that follows will be directed to a single-hand barbell.

One common exercise done with a free-weight barbell is the "curl", which the exerciser may do when standing or sitting with the upper body torso generally aligned vertically, or while lying against an inclined board whereupon the upper body torso and upper arm between the shoulder and elbow are angled the same as the incline of the board. During the curl, the upper arm preferably will be kept generally aligned with and at the side of the upper body torso. In the lower position, the arm is substantially straight, so that the lower arm between the elbow and gripping hand is also generally aligned with and at the side of the exerciser and the gripping hand is vertically lower than the elbow. The exerciser lifts the barbell from this lower position, by bending the arm only at the elbow, while the upper arm generally remains aligned at the exerciser's side, until in the upper position, the lower arm is angled upwardly away from the elbow and the gripping hand is vertically higher than the elbow, in front of and spaced from the upper body torso but reasonably close to the shoulder.

During the exercise, the gripping hand may move along an arcuate path around the elbow; and this arcuate path typically will define a plane extended through the elbow, the shoulder, or both, and may also be approximately vertically. The bicep muscle is stressed during this exercise, being evident by its bulge particularly when the gripping bar is aligned somewhat along a horizontal axis and the exerciser's palm faces upwardly.

The inventor has noticed that the efforts needed for the stressed bicep muscle to move and/or hold the barbell at various locations between the lower and upper positions vary substantially, particularly toward the upper position when the upper arm begins to be angle upwardly from the elbow. Thus, substantially less bicep effort is needed to hold the barbell near or in the upper position; and in fact, if poor form or the like aligns the gripping hand and barbell vertically above the elbow, the bicep may be allowed to become almost totally unstressed, almost as a rest period.

As the exercised muscles develop in size and/or strength and/or endurance, depending on the degree and/or duration of stressing, any rest period may detract from the effectiveness of the exercise. Also, certain portions of the bicep muscle, such as the top close to the shoulder, are not stressed significantly during a typical standing curl.

Other exercises commonly performed with free-weight barbells frequently have the same characteristic, vis, the muscle(s) primarily stressed to lift the barbell between the lower and upper positions, in fact, is(are) allowed to become somewhat or possibly even totally unstressed in the upper position.

One example is the "chest fly", performed with the exerciser lying on his/her back on a horizontal or inclined bench, which involves lifting a pair of barbells, one in each hand, from lower positions where the arms are extended substantially horizontally away from the body torso, to upper positions where the arms are extended substantially vertically from the body torso. With the arms held substantially straight, each gripping hand may move along a substantially vertical plane extended approximately through the shoulder. The chest muscles are stressed during this exercise; however, in the upper position, with the gripping hands and barbells aligned vertically over the shoulders, the chest muscles are allowed to become almost completely relaxed.

Another example is the "press", performed with the exerciser standing or sitting with the upper body torso aligned vertically or lying on his/her back on a horizontal or inclined bench, which involves lifting a barbell from a lower position where the arms are bent at the elbows and the barbell is at or close to the shoulders, to an upper position where the arms are extended substantially straight and the barbell is vertically aligned above the shoulders. The tricep muscle is stressed to move the barbell between these positions; but in the upper position, this muscle is allowed to become almost completely relaxed.

SUMMARY OF THE INVENTION

A basis object of the present invention is to provide a free-weight exercising barbell that can be used for stressing the muscle(s) of an exerciser in approximately the same manner as in exercising with a conventional free-weight barbell, while further stressing the muscle(s) throughout a greater range of the movement involved in the exercise, for yielding a more effective barbell.

Specific objects of the invention are to provide a free-weight exercising barbell that during use may be vertically lifted between lower and upper positions, to stress particular muscle(s) in moving the barbell, but the same muscle(s) further will be stressed substantially and possibly even to a degree related to that needed to move the barbell to the upper positions and/or different muscle(s) or region(s) of the same muscle(s) will be stressed substantially, while merely holding the barbell in the upper position.

To achieve these and other objects, the present invention may provide an exercising barbell with a substantially rigid frame having a gripping portion, a support portion, and a weight portion. The three portions are spaced apart and oriented such that the center of gravity of the barbell is spaced from the gripping and support portions. The gripping portion is suited to be gripped by an exerciser's hand, and the support portion is suited then to cooperate with a body-part of the exerciser spaced from the gripping hand, to form a two-point support of the barbell, to allow the exerciser to move the barbell between lower and upper positions in the course of an exercise, whereby muscle(s) of the exerciser must be stressed. The gripping and weight portions are disposed to be horizontally spaced apart in the upper position, to cause the barbell to continue to stress the same lifting muscle(s) of the exerciser.

BRIEF DESCRIPTION OF THE DRAWINGS

Further objects, advantages and features of the present invention will appear from the following disclosure and description, including as a part thereof the accompanying drawings, in which:

FIG. 5 is a frontal view of an exerciser (somewhat in phantom) using a barbell similar to that use in FIG. 1 in a side-sway exercise, for stressing the "love handles" at the waist;

FIG. 6 is a perspective view of an exerciser (somewhat in phantom) using a two-hand embodiment of the disclosed barbell, for exercising a two-hand curl;

FIG. 7 is an elevational view of specific portions of a barbell similar to that in FIG. 6, showing means for adjusting the span of the grips on the barbell;

FIGS. 8 and 9 are perspective views of exerciser (somewhat in phantom) using another embodiment of the disclosed barbell for exercising a reverse one-hand curl, for stressing the tricep;

FIG. 10 is a side elevational view of the barbell of FIGS. 8 and 9; and FIG. 11 is a top plan view of the barbell of FIG. 10.

DETAILED DESCRIPTION OF ILLUSTRATED EMBODIMENTS

As the exercising barbells to be disclosed are intended to support weight, typically in the form of separate weight plates, which may at times be quite heavy, and as the barbells may be thrown around or dropped during use, they should be fabricated of heavy gauge steel. The components not illustrated in great detail form no part of the invention and may be of conventional construction for free-weight barbells.

Figure 1:
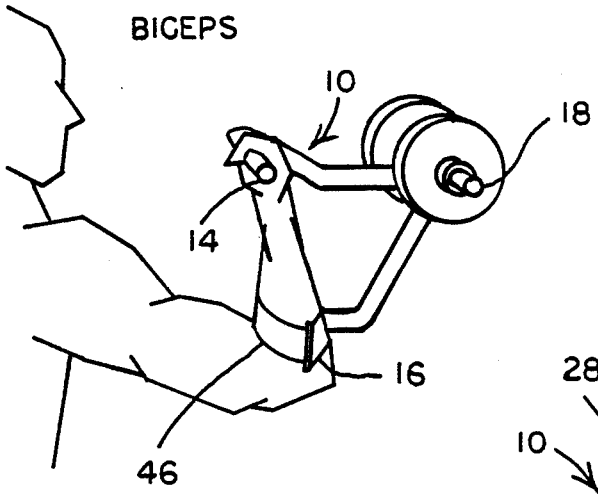
FIG. 1 is a perspective view of an exerciser (somewhat in phantom) using an embodiment of the barbell to be disclosed herein in a one-hand curl, for stressing the bicep.
Figure 3:
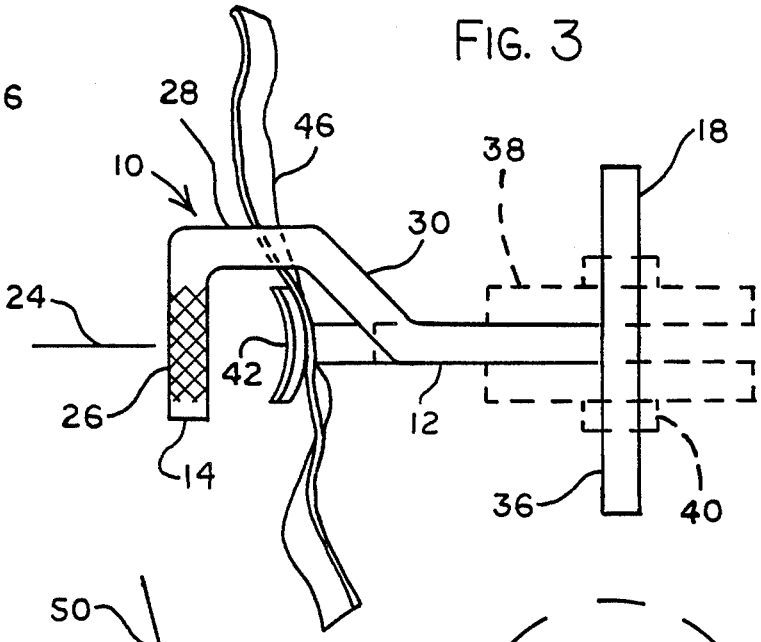
FIG. 3 is a top plan view of the barbell of FIG. 2.
Figure 2:
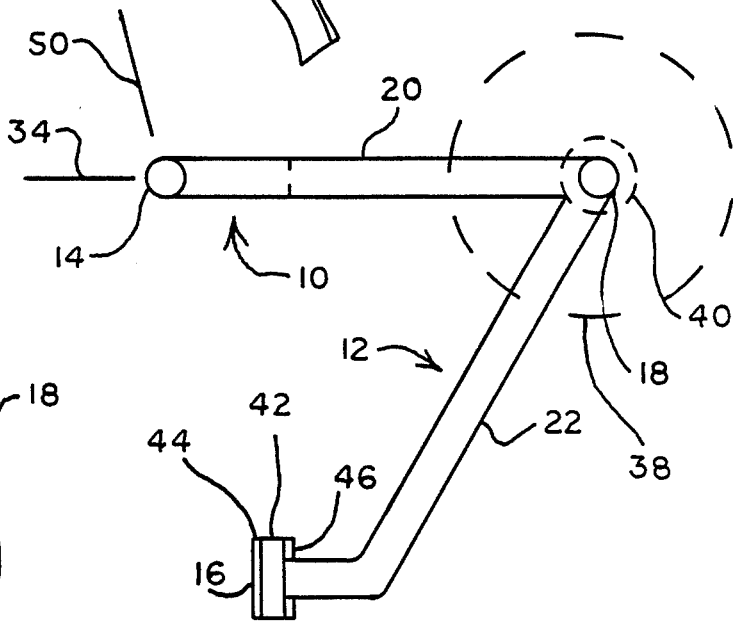
FIG. 2 is a side elevational view of a specific barbell similar to that used in FIG. 1.

FIG. 1 shows an exerciser using an inventive barbell for a one-hand curl; and a similar barbell 10 is illustrated in greater detail in FIGS. 2 and 3. The barbell 10 is formed as a unitary structural frame 12 having a gripping portion 14, a support portion 16, and a weight portion 18; and bars 20 and 22 connect between, respectively, the adjacent gripping portion 14 and weight portion 18, and the adjacent weight portion 18 and support portion 16. The three portions 14, 16 and 18 are spaced apart and, as can be seen in FIG. 3, lie along or somewhat symmetically of plane 24 extended through the portions.

As illustrated in FIG. 3, the gripping portion 14 is extended transverse to and possibly even normal to the defined plane 24, and is of a length at least the width of an exerciser's hand, suited to be gripped by the exerciser's gripping hand, either the right of left. The gripping portion 14 can be knurled, as at 26, for improved grip. The frame bar 20 between the gripping portion 14 and weight portion 18 is offset from the plane 20, as at 28 and 30, to make room for the exerciser's hand and wrist when gripping the barbell, while having the gripping hand located approximately symmetrically of the plane. The frame bar 20, as seen in FIG. 2, otherwise lies somewhat along another plane 34 extended normal to the plane 24.

The weight portion 18 is illustrated as having a bar 36 formed as a cross member of a "T" at the juncture of the connecting bars 20 and 22, either or both of which can be considered as being the vertical member of the "T"; whereby bar 36 is extended normal to the plane 24. Weight plates 38 may be positioned on the bar 36 and held in place thereon by clamps 40 (each being shown in phantom only).

The support portion 16 is spaced from the gripping portion 14 a distance suited to engage the lower arm of an exerciser, just above the elbow, when the gripping hand is holding onto the gripping portion 14. The support portion 16 includes a structural plate 42, which to more closely complement the convex upper arm of the exerciser, may be curved concave through the plane 24 (as can be seen in FIG. 3) approximately about an axis extended within the plane 24 and approximately through the gripping portion 14. The plate 42 may also be covered by padding 44 for improved comfort. A securing strap 46 near the support plate 42 may be wrapped around the exerciser's lower arm, and secured as by a conventional hook-loop fastener means (not shown, but commonly identified as VELCRO fasteners) on the straps, to hold the plate firmly against the exerciser's lower arm.

The gripping bar portion 14 and the support plate 42 generally define a plane 50 extended transverse to, and even normal to both prior named planes 24 and 34. It will be appreciated that typically weight plates 38 of equal weight will be place on the opposite ends of the bar 36, to provide that the center of gravity of the overall weight of the barbell, including the structural frame 12 and clamps 40, will be approximately at the defined plane 24. The nonsymmetrical frame 12 including the gripping and support portions and the connecting bars, will cause the overall center of gravity of the barbell 10 to lie somewhere between the plane 50 and the weight portion bar 36, spaced from both the gripping bar portion 14 and the support plate 42. However, because the greatest weight, in the form of the weight plates, will be concentrated at the weight portion 18 and at the plane 24, for simplicity sake, the barbell center of gravity will be assumed to be at this location.

When the exerciser's hand firmly holds the gripping bar portion 14 and the support plate 42 is securely positioned against the exerciser's lower arm just above the elbow, a two-point connection is made between the exerciser and the barbell 10, and the weight portion 18 is spaced from the two-point connection. During most any typical exercise movement, it can be appreciated that the weight portion 18 will trace a path different from the paths followed by the two-point connection at the gripping portion 14 and the suport portion 16.

Figure 4:
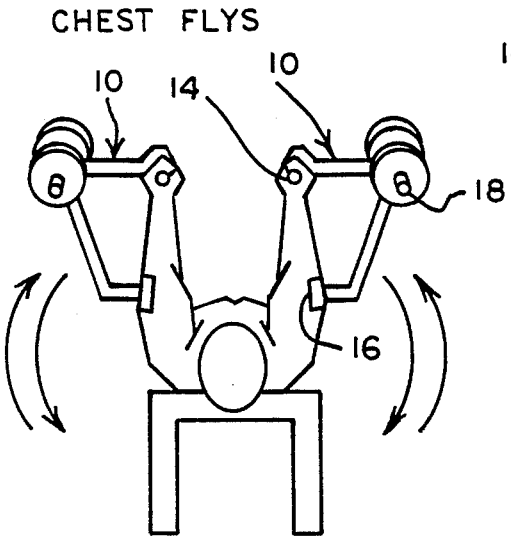
FIG. 4 is a perspective view of an exerciser (somewhat in phantom) using a pair of barbells similar to that used in FIG. 1 in a chest fly exercise, for stressing the chest.

As has already been noted, various exercises may be done with the barbell 10, three examples being illustrated specifically in FIGS. 1, 4 and 5.

In curling (FIG. 1), the two-point support fixes the barbell 10 to the lower arm of the exerciser, with the weight portion 18 being remote from the shoulder and with the defined plane 24 being extended through the shoulder and elbow of the exerciser. The barbell 10 is lifted to move the weight portion 18 along the movement plane 24, from the lower position toward the upper position, to stress the bicep.

During the initial movement from the lower position, the bicep would be stressed in approximately the same manner and degree as in curling a conventional barbell of the same weight, as the barbell weight portion 18 is no further from the body torso than the gripping hand and the barbell weight only will control. However, as the upper arm nears or passes being approximately horizontal, the barbell weight portion 18 now begins to trace a path that is horizontally spaced beyond the gripping portion 14 and support portion 16, so that the offset location of the barbell weight comes into play.

Even when the barbell is in its upper position in a standing curl performed with good form with the upper arm generally aligned vertically at the side of the exerciser' body torso, the barbell weight portion 18 is horizontally spaced beyond the gripping hand and elbow, remote from the shoulder, which tends to straighten the arm and stresses the bicep in resisting this tendency. Should the exerciser, as illustrated in FIG. 1, attempt to curl with poor form by pivoting the upper arm forwardly about the shoulder to swing the elbow in front of the upper body torso, to where in the upper position the upper arm may even become aligned vertically, the barbell weight portion 18 is still horizontally spaced forwardly beyond the gripping hand and elbow, remote from the shoulder, tending to straighten the upper arm at the elbow.

The disclosed barbell 10, during the curl, stresses the bicep in the region very close to the shoulder, which region normally will not be significantly stressed when using a conventional barbell. The disclosed barbell 10 also stresses the same muscle(s) needed in lifting the barbell to the upper position of the exercise, generally to some lesser degree, merely in holding the barbell in the upper position.

During the "chest fly" (see FIG. 4), the two-point support fixes the barbell 10 to the lower arm of the exerciser, with the weight portion 18 being remote from the shoulder and with the defined plane 24 being extended through the shoulder and elbow of the exerciser. The exerciser lifts the barbell 10 along the movement plane 24, from the lower positions (not shown, where the arms are extended substantially horizontally away from the body torso) to the upper positions as illustrated, where the arms and gripping hands are extended substantially vertically aligned over the shoulders. Agains, for the initial part of movement from the lower position, the chest muscles are stressed in approximately the same manner and degree as in using a conventional barbell of the same weight. However, as the upper arms near or pass being angled approximately mid-way between the horizontal and vertical, the barbell weight portion 18 now begins to trace a path that is horizontally spaced beyond the gripping portion 14 and support portion 16, almost at or extended through the elbow and remote from the shoulder, so that a leverage factor of the barbell weight comes into play. With the arms held vertically, each barbell weight portion 18 is horizontally further beyond the gripping hand and elbow, from the shoulder, which tends to rotate the arms to the lower position and stress the chest muscles additionally. This is in contrast to doing the chest fly with equally heavy conventional barbells (not shown) having its center of gravity at the gripping hand, where the chest muscles can become relaxed in the upper position.

FIG. 5 illustrates an exercise using the barbell 10 in a side-sway exercise, especially useful for stressing the side muscles at the waist, to harden and remove the common "love handes". The exerciser would hold the gripping portion 14 wiht one hand in close proximity to the other shoulder, and would locate the support portion 16 against the upper arm spaced below that shoulder and just above the elbow, with the barbell weight portion 18 being off to the side of the exerciser. The tow-point support thus in effect fixes the barbell 10 to the upper arm of the exerciser, and the mere presence of the barbell stresses the opposite side muscles at the waist, even when standing straight and vertically. Additional stressing could occur by bending at the waist, in a side-to-side manner.

The barbell 110 illustrated in FIGS. 6 and 7 is suited for two-hand curling, and may have the same operative components as barbell 10, except having two such frames 112 formed off of a common weight portion bar 126, which may be sized a meter or more long. Each frame 112 may have a gripping portion 114, a support portion 116, and a weight portion 118; bars 220 and 222 connect between these portions; and securing straps 146 near each support portion 116. The corresponding gripping bar portions 114 may be spaced apart a suitable distance to allow the exerciser to grip them respectively with the right and left hands when spaced apart approximately shoulder width. The weight plates 138 may be added to the free ends of the weight bar 136 outwardly adjacent the frames 112, and if done symmetrically, would locate the barbell center of gravity approximately between the frames 112 to lie up approximately midway in front of the exerciser.

For providing additional versatility, the bar 136 may be cut through midway between the frames 112, and an adjustable sleeve coupling 139 may be provided to telescope over the now exposed two ends of the cut bar. A plurality of axially separate holes 145 provided in the sleeve coupling may thus become aligned selectively with a single through holes in each bar near its end, and a locking pin 147 inserted in these aligned holes would fix the distance between the frames 112 to yield different gripping options for the exerciser.

The barbell 210 illustrated in FIGS. 8–11 is suited for exercising a reverse one-hand curl, for stressing the tricep. The same components of barbell 10 are present in the barbell 210, including a unitary structural frame 212 having a gripping portion 214, a support portion 216, and a weight portion 218, and securing straps 246 near each support portion 216; provided however the support portion 216 lies between the gripping portion 214 and the weight portion 218, and the bars 220 and 222 between these portions are somewhat aligned axially at their juncture. The tree portions 214, 216 and 218 are spaced apart and lie along or somewhat symmetrically of plane 224 extended through the portions (see FIG. 11).

The support portion 216 is connected off of the bars 220 and 222, at their juncture, by spacer bar 223, to provide the weight portion 218 is offset from the two-point support plane 250 defined by the gripping portion 214 and the support portion 216. The weight portion 218 is illustrated as having a stop 236 formed on the connecting bar 222 near its free end, to allow weight plates 38 to be positioned axially on the bar and held in place against the stop by a clamp 40 (each being shown in phantom only). The center of gravity of the overall barbell 210 will lie on the defined plane 224, somewhere between the support portion 216 and the weight portion 218 but will be considered as being at the weight portion 218.

The barbell is used by securing the straps 246 around the exerciser's lower arm, just below the elbow, while the gripping hand holds onto the gripping portion 214, with the weight portion 218 then being located behind the exerciser. In the lower position of the barbell, the gripping portion 214 will actually be in a raised position, with the arm bent at the elbow; while in the upper position of the barbell, the gripping portion 214 will be in a lowered position and lower than the elbow, with the arm being substantially straight.

In moving the barbell between the lowered and upper positions, the tricep will be stressed to lift the barbell. As the upper arm nears or passes being approximately horizontal, the weight portion 218 of the barbell traces a path that is horizontally spaced beyond the two-point support plane 250, and the motion plane 224 will extend through the elbow and the shoulder, with the leverage factor of the barbell weight coming into play. Even when the barbell is in its upper position (FIG. 9) where the arm is substantially straight and the lower arm is generally aligned vertically and at the side of the exerciser, the barbell weight portion 218 is horizontally spaced rearwardly of the shoulder and the support plane 250 defined approximately by the gripping hand and elbow, which tends to bend the arm at the elbow, and stresses the tricep just to hold the arm straight. Thus, substantially the same tricep muscles needed to straighten the arm will be stressed when the arm is straight and the barbell is in its upper position.

Also, other benefical exercises could possibly be performed with the disclosed barbells. For example, one might secure the barbell 10 to the lower arm, with the hand grip reversed, vis with the palms facing downwardly when the upper arm is horizontal. Also, one might further then locate the weight portion 18 between the holding arm and the other arm in front of the exerciser, with the upper arm extended horizontally from the shoulders. The shoulder and wrist would be stressed, in an exercise that would raise and lower the weight portion, while the upper arm were rotated in a vertical plane between approximately horizontal and vertical alignments. In addition to the already existing offset leverage force of the nonsymmertical frame, which may magnify the stresses on the muscles, the muscles could be stressed in even new manners not possible with conventional barbells.

By way of example, the barbell 10 may space the gripping portion 14 and the weight portion 18 by between 5–15 inches, possibly 10 inches; may space the weight portion 18 and the support portion 16 by between 10–20 inches, possibly 14 inches; and may space the gripping portion 14 and the support portion 16 by between 8–15 inches, possibly 12 inches. This provides that the normal offset distance of the weight portion from the two-point support defined by the gripping portion 14 and the support portion 16 be between 5–15 inches, possibly 10 inches. The barbell 210 may space the gripping portion 214 and the support portion 216 by between 8–15 inches, possibly 12 inches; may space the support portion 216 and weight portion 218 by between 10–20 inches, possibly 15 inches; and may space the gripping portion 14 and the weight portion 218 by between 15–35 inches, possibly 23 inches. This provides that the normal offset distance of the weight portion from the two-point support defined by the gripping portion 214 and the support portion 216 be between 0–20 inches, possibly 12 inches.

It might be noted that the three portions of barbell 10 are spaced apart somewhat as an oblique or equilateral triangle, while the three portions of barbell 210 are spaced apart somewhat as an obtuse triangle or on-line. It will be appreciated that the distances between the spaced gripping portion, support portion, and weight portion of the illustrated barbells can be varied, as well as the angles between each, to change the magnitude of the leverage factor or the location in the path of movement of the weight portion during the exercise and the location along the path when maximum leverage factor may take place. The sequence of mounting the three portions relative to one another, by the bars 20 and 22 or 220 and 222 can of course be varied or changed. Also, while the two-point support of the barbells 10 or 210 has illustrated gripping portion 14 or 214 and a strap-on support 16 or 216, it could also be defined by eliminating the gripping portion and substituting a second strap-on support (not shown) similar to the illustrated support portion 16 or 216.

Thus, while only specific embodiments of the invenion have been illustrated, it may be apparent that variations could be made therefrom without departing from the inventive concept. Accordingly, the invention is to be limited only by the scope of the following claims.

What is claimed as my invention is:

1. An exercising barbell, comprising the combination of a substantially rigid frame having spaced gripping, support and weight portions; elongated bars between the portions; and strap means near the support means and means to secure the strap means together in a looped fashion;

said gripping portion being suited to be gripped by an exerciser's hand, and the support portion being suited then to cooperate with and be secured by the looped strap means to a part of the exerciser's body spaced from the gripping hand, to form a two-point support of the barbell relative to the exerciser, to allow the exerciser to move the two-point support generally along a path within a vertically extended plane and shift the barbell between lower and upper positions in the course of an exercise, whereby the muscle(s) of the exerciser must be stressed; and the three portions being oriented such that the center of gravity of the barbell is generally proximate the weight portion and is spaced from the gripping and support portions; and in the upper position, said weight portion being horizontally spaced from said path, to cause the barbell to continue to stress the same lifting muscle(s) of the exerciser.

2. An exercising barbell according to claim 1, further comprising the combination of said spaced gripping, support and weight portions being arranged approximateley as an oblique triangle, and the barbell is particularly suited to do exercises in the form of a curl, a chest fly, or a side sway.

3. An exercising barbell according to claim 1, further comprising the combination of said gripping, support and weight portions being arranged as a substantially flattened triangle, with said gripping and weight portions being furthest spaced apart, and the barbell is particularly suited to do exercises in the form of a reverse curl.

4. An exercising barbell according to claim 1, further comprising the combination of the frame bars extended between the gripping portion and the weight or support portion disposed adjacent thereto, being offset laterally from the vertically disposed plane in the region adjacent the gripping portion, to make room for the exerciser's hand and wrist when gripping the gripping portion; and the support portion having a plate curved concave approximately about an axis extended approximately, within the gripping portion; and padding means over the support portion plate.

5. An exercising barbell, comprising the combination of a substantially rigid frame having a gripping portion, a support portion, and a weight portion;

the three portions being spaced apart and oriented such that the center of gravity of the barbell is spaced from the gripping and support portions and is approximately on a single plane directed through the spaced portions;

strap means near the support portion adapted to be wrapped around the exerciser's lower arm, just above the elbow, and means to secure the strap means as wrapped aroung the exerciser's lower arm, operable to hold the support portion firmly against the exerciser's lower arm;

said gripping portion being suited to be gripped by an exerciser's hand, and the support portion being suited then to cooperate with a part of the exerciser's body spaced from the gripping hand, to form a two-point support of the barbell relative to the exerciser, to allow the exerciser to move the barbell along a path between lower and upper positions in the course of an exercise, whereby muscle(s) of the exerciser must be stressed; and in the upper position, said weight portion being spaced from at least one of said gripping and support portions, horizontally and in a direction of said path of barbell movement, to cause the barbell to continue to stress the same lifting muscle(s) of the exerciser.

6. An exercising barbell according to claim 5, further comprising the combination of the gripping portion being elongated in the direction transverse to the defined single plane, and being of a length at least the width of the exerciser's gripping hand suited to be gripped by the exerciser's gripping hand.

7. An exercising barbell according to claim 6, further comprising the combination of said frame being extended between the gripping portion and the weight or support portion disposed adjacent thereto, for holding said respective portions relative to one another, and being offset laterally from the single plane in the region adjacent the gripping portion, to make room for the exerciser's hand and wrist when gripping the gripping portion.

8. An exercising barbell according to claim 5, further comprising the combiantion of the support portion having a plate curved approximately about an axis extended within the single plane and approximately through the gripping portion.

9. An exercising barbell according to claim 8, further comprising the combination of padding means over the support portion plate.

10. An exercising barbell according to claim 5, further comprising the combination of the support portion having a plate curved concave approximately about an axis extended within the single plane and approximately through the gripping portion, and said support portion being adapted to be firmly held against the exerciser's lower arm just above the elbow.

11. An exercising barbell according to claim 10, futher comprising the combination of the gripping portion being elongated in the direction transverse to the defined single plane, and being of a length at least the width of the exerciser's hand suited to be gripped by the exerciser's hand, and said frame being extended between the weight portion and the support or gripping portion disposed adjacent thereto, for holding said respective portions relative to one another; said frame being offset laterally from the single plane in the region adjacent the gripping portion, to make room for the exerciser's hand and wrist when gripping the gripping portion.

* * * * *